US005357100A

United States Patent [19]

Du Toit

[11] Patent Number: 5,357,100

[45] Date of Patent: Oct. 18, 1994

[54] IONIZING RADIATION CONVERTER WITH CATADIOPTRIC ELECTRON FOCUSING

[75] Inventor: Albert G. Du Toit, Pretoria, South Africa

[73] Assignee: CSIR, South Africa

[21] Appl. No.: 9,295

[22] Filed: Jan. 26, 1993

[30] Foreign Application Priority Data

Jan. 27, 1992 [ZA] South Africa ..... 92/0541

[51] Int. Cl.[5] ..... H01J 31/50

[52] U.S. Cl. ..... 250/214 VT; 313/525

[58] Field of Search ..... 250/214 VT; 313/525, 313/526, 541

[56] References Cited

U.S. PATENT DOCUMENTS

| | | | |
|---|---|---|---|
| 3,777,201 | 12/1973 | Einstein | 250/214 VT |
| 3,974,376 | 8/1976 | van der Sande | 250/214 VT |
| 4,208,577 | 6/1980 | Wang | 250/214 VT |
| 4,555,731 | 11/1985 | Zinchuk | 250/214 VT |
| 4,585,935 | 4/1986 | Butterwick . | |

FOREIGN PATENT DOCUMENTS

| | | |
|---|---|---|
| 0424148A3 | 10/1990 | European Pat. Off. . |
| 2349949 | 4/1977 | France . |
| 762611 | 4/1976 | South Africa . |

OTHER PUBLICATIONS

Paper from the Proceedings of the Society of Photo-optical Instrumentation Engineers entitled "Application of Optical Instrumentation In Medicine" dated Nov. 29, 30, 1992.

R. Evrard; Catadioptric Electron Optics Using a Retarding Electrostatic Field and Its Application to the Development of Short Image Tubes of Very High Performance; 1979; pp. 133–141; Advances in Electronics and Electron Physics; vol. 52.

A. G. DuToit and C. F. VanHuyssteen; The Luminous Efficiency of a Phosphor Layer in the Forward and Backward Directions; 1985; Advances in Electronics and Electron Physics; vol. 64B.

*Primary Examiner*—David C. Nelms

*Attorney, Agent, or Firm*—Allegretti & Witcoff, Ltd.

[57] ABSTRACT

An ionizing radiation converter 10 comprises a vacuum tight enclosure 12; a cathode 16; an anode 18 defining a pinhole 20 and comprising an output phosphor layer facing away from the cathode; and focusing electrodes 26 and 30. The focusing electrodes, anode and cathode, in use, force photoelectrons, emitted by the cathode as a result of input ionizing radiation, to move through the pinhole, and back to the anode, so that the photoelectrons impinge on the output phosphor layer to provide an intensified signal representative of the input radiation.

12 Claims, 4 Drawing Sheets

IONIZING RADIATION CONVERTER WITH CATADIOPTRIC ELECTRON FOCUSING

BACKGROUND OF THE INVENTION

This invention relates to ionizing radiation converters, such as image intensifiers, and more particularly, to x-ray image intensifier tubes.

In this specification the term "ionizing radiation" is used to denote electromagnetic radiation associated with photons having energy of at least 15 ev. Thus, X-rays, gamma rays and some ultraviolet rays are all types of ionizing radiation. The term "ionizing radiation converter" includes within its scope ionizing radiation image intensifier tubes, but is not limited to such tubes and also includes ionizing radiation detectors, for example.

The X-ray image intensifier tubes known to the applicant comprise an input clement or cathode in the form of an ionizing radiation to photoelectron converter located towards one end of the tube, an anode located towards an opposite end of the tube and intermediate focusing electrodes. The anode comprises a layer of output phosphor on a face of a transparent output window facing the cathode. In use, the cathode is illuminated by X-rays to form a primary visible image on an input phosphor layer on the cathode. Photoelectrons emitted from the cathode as a result of the illumination are accelerated and focused by the focusing electrodes so that an intensified visible output image is caused in the output phosphor layer by the impinging photoelectrons. The image is visible through the transparent output window.

It is known that the clarity of an image produced by an X-ray image intensifier tube is proportional to the product of the quantum detection efficiency (QDE) and the modulation transfer function (MTF) of the tube. The ODE is a measure of the efficiency with which on average each absorbed X-ray photon is detected, that is, made visible, by the tube at its output. The MTF is a measure of the reduction in contrast and sharpness by the tube in the output image of the spatial detail of the primary image.

As is illustrated in U.S. Pat. No. 5,144,123 to Malashanko, it has been the general trend to improve the imaging quality of the conventional X-ray tubes by improving or eliminating some of the inefficient energy conversion processes in the conventional tubes. However, the imaging quality of such conventional tubes remains limited by the MTF of the refracting electron optics, with their inherent image defects, used in all these tubes. For example, input X-rays penetrate the cathode, impinge on the output phosphor and cause unwanted background and fogging in the image caused by the photoelectrons impinging on the output phosphor.

In 1978, in a different art, that of first generation night vision apparatus, the so-called fountain tube using catadioptric electron optics was disclosed by R. Evrard. This night vision tube had a 0.5 image magnification factor, it was never commercialized, since its photon gain was limited and it could not match the photon gain of later generations of conventional night vision apparatus, which comprise electron multiplier arrangements.

OBJECT OF THE INVENTION

Accordingly, it is an object of the present invention to provide an alternative ionizing radiation converter with which it is believed the aforementioned disadvantages of the conventional converters will at least be alleviated. Other object and advantages of the invention will be made more apparent hereinafter.

SUMMARY OF THE INVENTION

According to the invention there is provided an ionizing radiation converter comprising: a vacuum tight enclosure; a cathode located towards one end of the enclosure; an anode located towards another end of the enclosure; the anode defining a pinhole and comprising an impinging electron responsive region facing away from the cathode; and focusing means; the anode, cathode and focusing means, in use, force photoelectrons emitted by the cathode, as a result of input ionizing and radiation received on the cathode, to move in a direction towards the pinhole and through the pinhole whereafter the direction of movement is changed so that said photoelectrons impinge on the impinging electron responsive region to provide an intensified signal representative of the input radiation.

The anode, cathode and focusing means, in use, generate first and second opposing electric fields separated by the anode. The focusing means preferably comprises at least one intermediate focusing electrode located between the cathode and the anode and at least one output focusing electrode spaced from the anode on the other side thereof as the cathode to generate between itself and the anode the second electric field having a direction opposite to that of the first electric field generated between the cathode and the anode.

Suitable demagnification of the input radiation on the impinging electron responsive region may be obtained by means of a suitable voltage on the output focusing electrode, to yield a required photon gain for the converter.

Ionizing radiation barrier means which transmits photoelectrons may be provided between the cathode and anode. The anode preferably comprises the ionizing radiation barrier means. For example, the anode may be made of a suitable heavy metal or of processed lead glass. Alternatively, the anode may comprise a conductive carrier defining the pinhole and a layer of a suitable heavy metal or of lead glass defining an aperture which is in register with the pinhole.

With the hereinbefore described catadioptric electron optics and anode structure, the QDE and MTF of the converters according to the invention are believed to be better than those of conventional converters.

An antireflection surface may be provided on a face of the anode facing the cathode and the pinhole is preferably funnel-shaped.

In a first embodiment of the converter according to the invention, the impinging electron responsive region comprises a layer of output phosphor.

In a second embodiment, the impinging electron responsive region further comprises a charge coupled device (CCD) array located adjacent the layer of output phosphor, towards the cathode.

In a third embodiment, the impinging electron responsive region comprises an electron bombarded charge coupled diode (ECCD) array.

Also included within the scope of the present invention is a diagnostic ionizing radiation system comprising an ionizing radiation generator; an ionizing radiation image intensifier tube; and external image detection means in communication with an output of the ionizing radiation image intensifier tube; the ionizing image intensifier tube comprising a vacuum tight enclosure; a cathode located towards one end of the enclosure; an anode located towards another end of the enclosure, the anode defining a pinhole and comprising an impinging electron responsive region facing away from the cathode; and focusing means; the anode, cathode and focusing means, in use, force photoelectrons emitted by the cathode, as a result of input ionizing radiation received on the cathode, to move in a direction towards the pinhole and through the pinhole whereafter the direction of movement is changed so that said photoelectrons impinge on the impinging electron responsive region to provide an intensified signal representative of the input radiation at said output and which signal is detected by the external image detection means.

BRIEF DESCRIPTION OF THE DRAWING

The invention will now further be described, by way of example only, with reference to the accompanying drawings wherein.

DESCRIPTION OF PREFERRED EMBODIMENTS OF THE INVENTION

Figure 1:
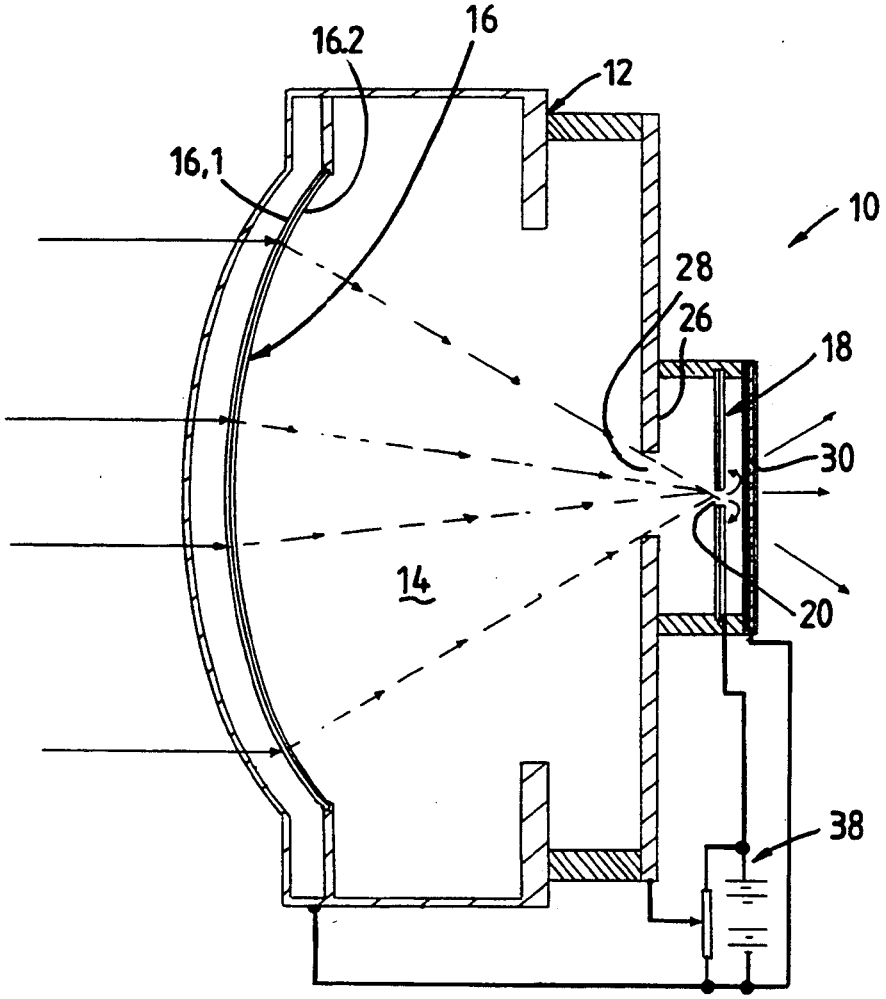
FIG. 1 is a diagrammatic axial section through an ionizing radiation converter according to the invention in the form of an X-ray image intensifier tube.

An ionizing radiation converter according to the invention in the form of an X-ray image intensifier tube is generally designated by the reference numeral 10 in FIG. 1.

The tube 10 comprises a stepped, tubular vacuum tight enclosure 12 defining an internal chamber 14, which is kept at substantially vacuum. At one end of the enclosure there is provided an X-ray-to-photoelectron converter or cathode 16. The cathode is in the shape of a convex sphere and comprises an outer layer 16.1 or an X-ray sensitive input phosphor and an inner layer 16.2 of a photoelectric material.

Figure 2:
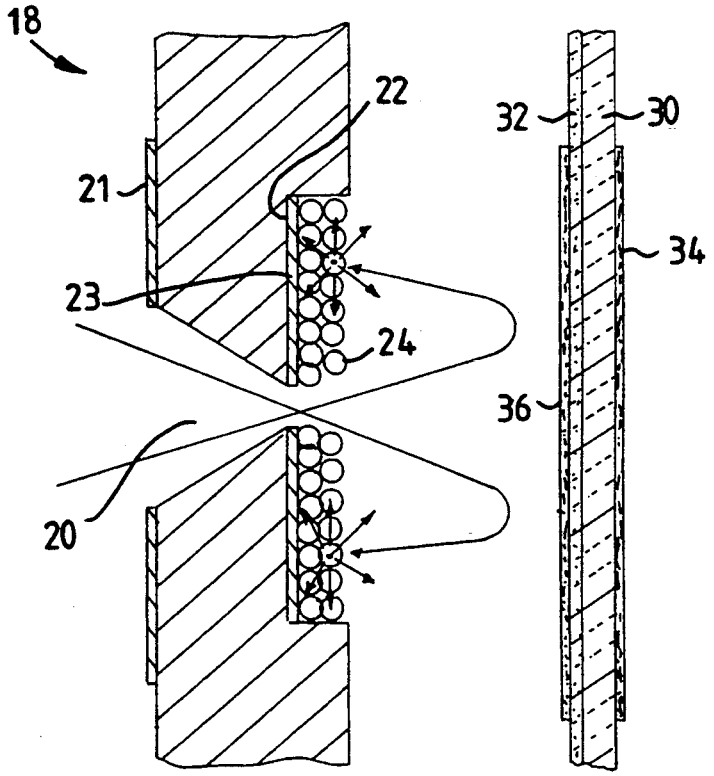
FIG. 2 is an enlarged axial sectional view of an anode and an output window only of a first embodiment of the tube in FIG. 1.

Towards the other end of the enclosure 12 there is provided a circular, disc-shaped anode 18 made of suitably processed lead glass, to form an ionizing radiation barrier. As best shown in FIG. 2, the anode defines a funnel shaped central pinhole 20 located at the center of curvature of the cathode 16. An antireflection surface 21 is provided on a face of the anode 18 facing the cathode. On a face 22 of the anode 18 facing away from the cathode 16, there is provided a light reflective surface 23 and an impinging electron responsive region in the form of an output phosphor layer 24.

As shown in FIG. 1, a circular focusing electrode 26 defining an axial aperture 28 is provided between cathode 16 and anode 18. As best shown in FIG. 2, on transparent glass output window 30, there is provided a transparent $SnO_2$ output focusing electrode 32. Both the face of the glass window 30 facing away from the anode and the face of the electrode 32 facing towards the anode are covered by antireflection coatings 34 and 36, respectively.

In use, power supply means 38 is utilized to keep the cathode 16 and electrode 32 at zero volts, while the anode 18 is kept at a voltage substantially higher than focusing electrode 26. Thus, an accelerating and converging electric field in the direction of the anode 18 is generated between the cathode 16 and the anode 18. Furthermore, a second electric field in the opposite direction is generated between the focusing electrode 32 and anode 18.

In use, the cathode 16 is illuminated with X-rays from an X-ray generator 52 (shown in FIG. 5) and which X-rays have passed through a subject 54 to be examined. The X-rays cause visible photons to be emitted by layer 16.1 (shown in FIG. 1) and which photons constitute a primary image. The photons in turn cause photoelectrons to be emitted by photocathode 16.2. These photoelectrons are accelerated and converged by the aforementioned accelerating and converging electric field, towards pinhole 20. The electrons then pass through the pinhole into the aforementioned second electric field between the anode 18 and electrode 32. This field first decelerates, then stops and reverses the direction of travel of the electrons and focuses the electrons on the substantially flat layer of output phosphor 24. The output phosphor then emits visible light constituting an intensified, but demagnified output image. The demagnification which is, amongst others, dependent on the voltage on the output focusing electrode, is utilized to achieve a required photon gain for the tube.

The accelerating electric field between anode 18 and cathode 16 forms a convergent electron lens which introduces chromatic and spherical aberrations. These are substantially cancelled by the uniform reverse and retarding field between anode 18 and output focusing electrode 32 of the converter according to the invention, with the result that the focal surface is virtually flat, with less distortion of the image and improved focusing over its whole area.

Furthermore, light is emitted from the output phosphor 24 towards window 30 from the face on which the electrons impinge. Light emitted in the opposite direction is also efficiently reflected by the reflective surface 23. In conventional X-ray image intensifier tubes an opaque light barrier has to be deposited on the output phosphor to prevent the light from the output phosphor reaching the light sensitive photocathode facing the output phosphor. This barrier absorbs energy from the electron beam and scatters the electrons which have to penetrate the barrier to impinge on the output phosphor. If the barrier is highly reflecting, multiple reflections between the barrier and the phosphor reduce the contrast. If the layer is not reflecting, the light output will be significantly reduced. This loss of either resolution or brightness, or both, is reduced in the impinging electron responsive region 24 of the tube according to the present invention.

Still further, the radiation barrier of the anode 18 prevents transmission of input X-rays, which may have penetrated the cathode 16, to the output phosphor layer 24. Thus, unwanted background or fogging caused by such penetrating X-rays is reduced in the output image caused on the impinging electron responsive region of the tube according to the invention, which region faces away from the cathode 16.

Figure 5:
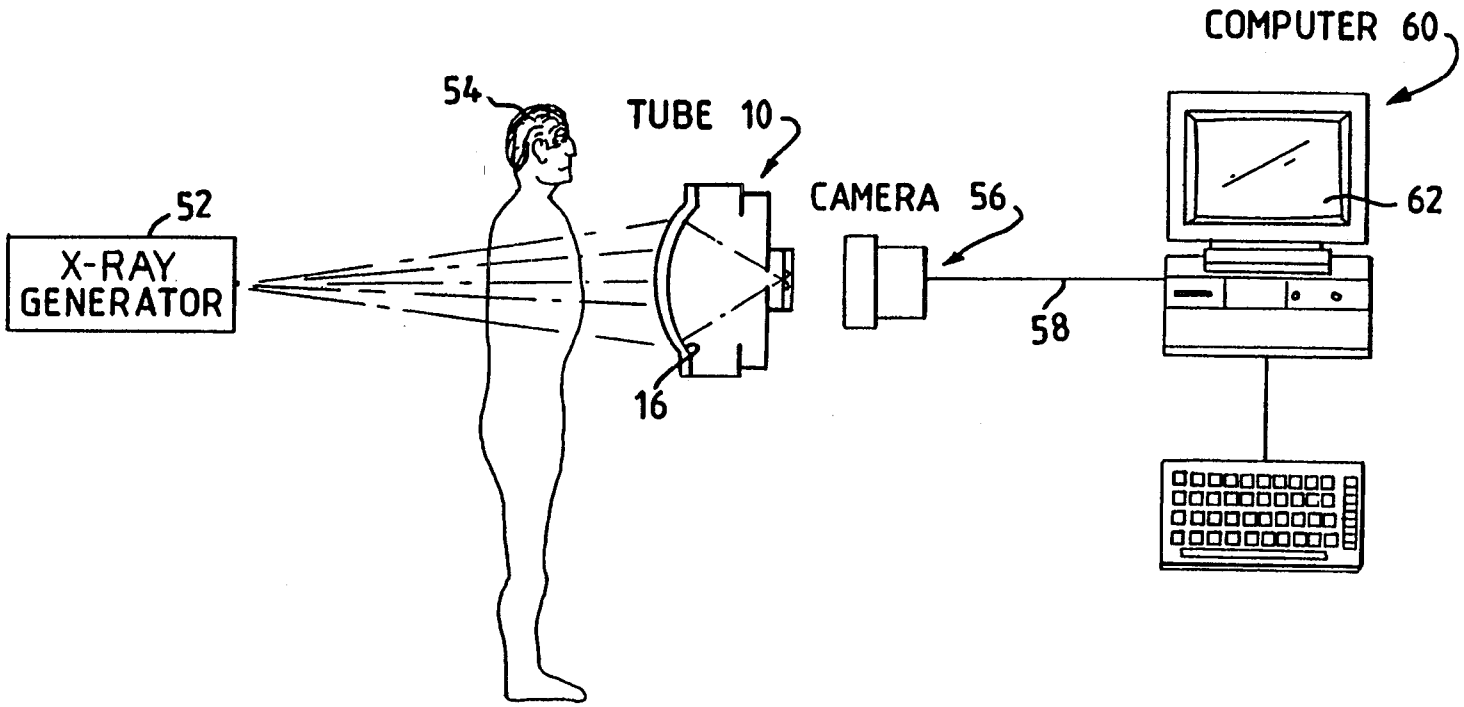
FIG. 5 is a schematic diagram of a diagnostic X-ray system comprising an X-ray image intensifier tube according to the invention.

As shown in FIG. 5, the visible output image is captured by a video camera 45 which is connected via a data communication link 58 to a computer 60. The output image may be displayed in real time on monitor 62 or the data relating to the image may be captured, stored and processed by computer 60, for subsequent display and/or for diagnosis.

Figure 3:
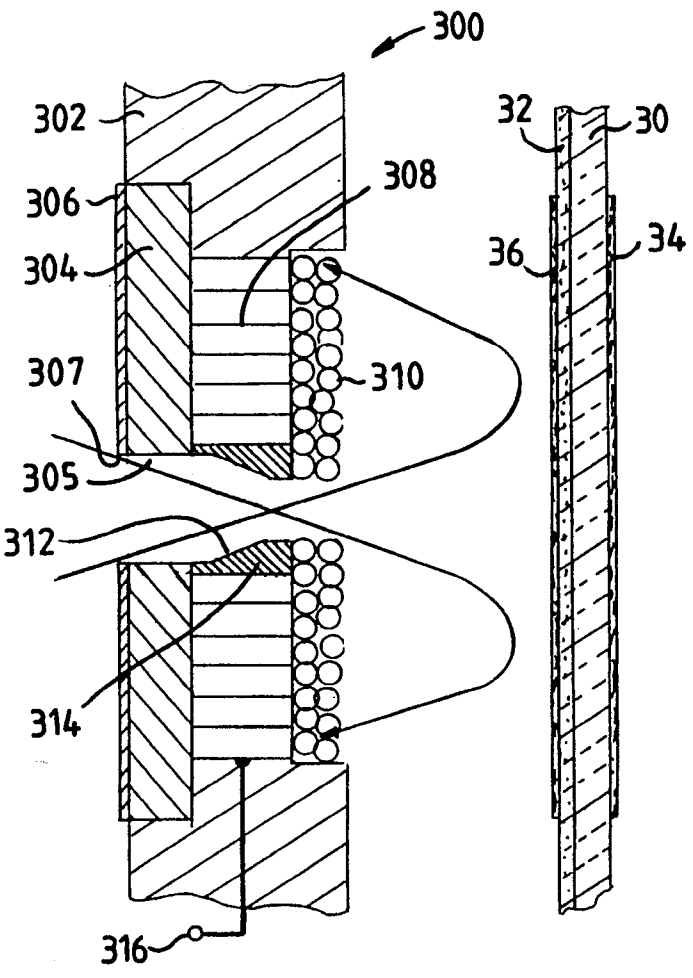
FIG. 3 is a similar view of an anode and an output window only of a second embodiment of the tube in FIG. 1.

In FIG. 3, there is shown an alternative structure for the anode, which is designated by the reference numeral 300 and which forms part of a second embodiment of the tube according to the invention. The remainder of the tube is the same as that described with reference to FIGS. 1 and 2. The anode 300 comprises a conductive circular carrier 302. An ionizing radiation barrier in the form of a layer 304 of a suitable heavy metal defining a small aperture 305 is provided on the face of the carrier facing the cathode. An antireflection layer 306 defining an aperture 307 is superimposed on layer 304. A charge coupled device (CCD) array 308 is provided between layer 304 and output phosphor layer 310. A funnel-shaped pinhole 312 is defined in insert 314. The apertures 305 and 307 are in register with pinhole 312.

The operation of the tube comprising anode 300 is substantially similar to that of tube 10, except that the photons emitted by output phosphor layer 310 are detected and received by CCD array 308. An electric signal representative of the input radiation is provided at output 316. In this embodiment the output window 30 and focusing electrode 32 need not be transparent.

Figure 4:
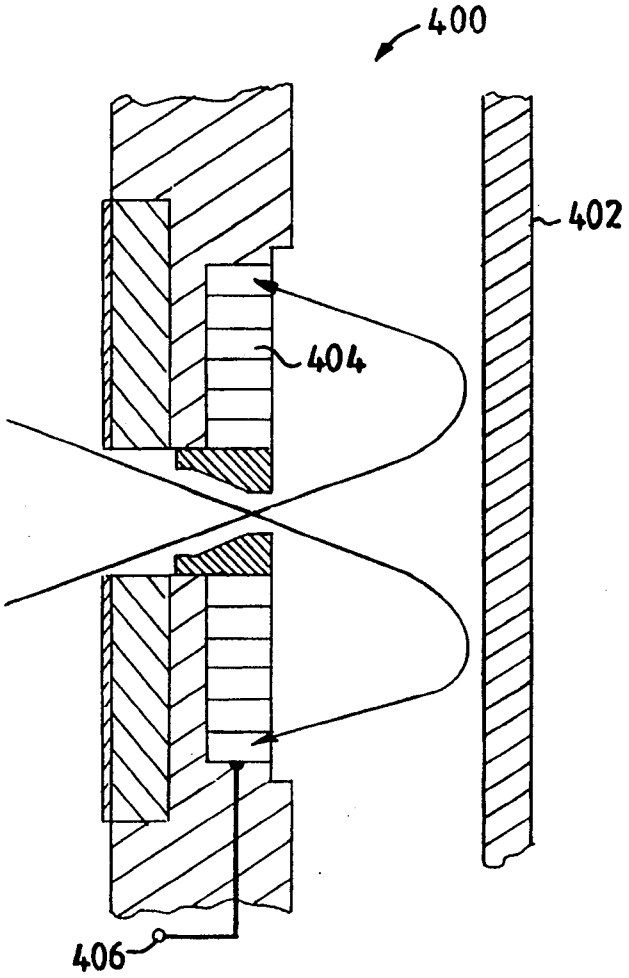
FIG. 4 is a similar view of an anode and focusing electrode only of a third embodiment of the invention.

In FIG. 4, there is shown yet another alternative structure for the anode, which is designated by the reference numeral 400 and which forms part of a third embodiment of the tube according to the invention. The remainder of the tube is the same as that described with reference to FIGS. 1 and 2, except that the output window 30 is dispensed with, but an output focusing electrode 402 is retained.

The structure of anode 400 differs from that in FIG. 3 in that the CCD array 308 and output phosphor layer 310 of anode 300 are substituted by an electron bombarded charge coupled diode (EBCCD) array 404. An electronic output signal representative of the input radiation is provided at output 406.

When one of the anodes 300 or 400 is utilized, the camera 56 in the system shown in FIG. 5 is dispensed with. Either output 316 or output 406 is connected via a data communications link to a suitable interface (not shown) in computer 58 or to a video monitor (not shown).

It will be appreciated that there are many variations in detail on the converter according to the invention without departing from the scope and spirit of the appended claims.

I claim:

1. An ionizing radiation converter comprising:

a vacuum tight enclosure; a cathode responsive to ionizing radiation located towards one end of the enclosure; an anode located towards another end of the enclosure; the anode defining a pinhole and comprising an impinging electron responsive region facing away from the cathode; ionizing radiation barrier means located between the cathode and anode and defining a single aperture; and catadioptric electron focusing means; whereby, in use, the catadioptric electron focusing means, anode and cathode force photoelectrons, emitted by the cathode as a result of input ionizing radiation received on the cathode, to move in a direction towards and through the aperture and pinhole, whereafter the direction of movement of said photoelectrons is changed so that the photoelectrons impinge on the impinging electron responsive region to provide an intensified signal representative of the input radiation.

2. An ionizing radiation converter as claimed in claim 1 wherein the anode, cathode and focusing means, in use, generate two opposing electric fields separated by the anode to cause said photoelectrons to move from the cathode through the pinhole to impinge on the impinging electron responsive region.

3. An ionizing radiation converter as claimed in claim 1 wherein the ionizing radiation barrier means comprises a layer of an ionizing radiation absorbing material.

4. An ionizing radiation converter as claimed in claim 3 wherein the absorbing material comprises lead glass of a suitable heavy metal.

5. An ionizing radiation converter as claimed in claim 3 wherein the anode comprises a conductive carrier defining the pinhole wherein the layer of an ionizing radiation absorbing material is located on a face of the anode facing towards the cathode and wherein the aperture is in register with the pinhole.

6. An ionizing radiation converter as claimed in claim 1 comprising an antireflection surface on a face of the barrier facing the cathode.

7. An ionizing radiation converter as claimed in claim 1 wherein the pinhole is funnel-shaped.

8. An ionizing converter as claimed in claim 1 wherein the impinging electron responsive region comprises a layer of output phosphor.

9. An ionizing radiation converter as claimed in claim 8 wherein the impinging electron responsive region further comprises a charge coupled device (CCD) array located adjacent the layer of output phosphor towards the cathode.

10. An ionizing radiation converter as claimed in claim 1 wherein the impinging electron responsive region comprises an electron bombarded charge coupled diode (ECCD) array.

11. A diagnostic X-ray system comprising an X-ray generator; an X-ray image intensifier tube, and external image detection means in communication with an output of the X-ray image intensifier tube; the ionizing radiation image intensifier tube comprising a vacuum tight enclosure; a cathode response to X-rays located towards one end of the enclosure; an anode located towards another end of the enclosure, the anode defining a pinhole and comprising an impinging electron responsive region facing away from the cathode; X-ray barrier means located between the cathode and the anode and defining a single aperture; and catadioptric electron focusing means; whereby, in use, the anode, cathode and catadioptric electron focusing means force photoelectrons emitted by the cathode, as a result of input X-rays received on the cathode, to move in a direction towards and through the aperture and pinhole whereafter the direction of movement is changed so that said photoelectrons impinge on the impinging electron responsive region to provide an intensified signal representative of the input radiation at said output and which signal is detected by the external image detection means.

12. An ionizing radiation converter comprising:

a vacuum tight enclosure; a cathode responsive to ionizing radiation located towards one end of the enclosure; an anode defining a pinhole and comprising an impinging electron responsive region facing away from the cathode; and catadioptric electron focusing means; whereby, in use, the catadioptric electron focusing means, anode and cathode force photoelectrons, emitted by the cathode as a result of input ionizing radiation received on the cathode, to move in a direction towards the pinhole and through the pinhole, whereafter the direction of movement of said photoelectrons is changed so that the photoelectrons impinge on the impinging electron responsive region to provide an intensified signal representative of the input radiation.

* * * * *